US008590552B2

(12) United States Patent
Stitely

(10) Patent No.: US 8,590,552 B2
(45) Date of Patent: Nov. 26, 2013

(54) RING CANE

(76) Inventor: Shianne Stitely, Waynesboro, PA (US)

( * ) Notice: Subject to any disclaimer, the term of this patent is extended or adjusted under 35 U.S.C. 154(b) by 0 days.

(21) Appl. No.: 12/660,013

(22) Filed: Feb. 19, 2010

(65) Prior Publication Data

US 2011/0203625 A1 Aug. 25, 2011

(51) Int. Cl.
*A45B 3/00* (2006.01)

(52) U.S. Cl.
USPC ..... 135/66; 135/65; 135/72; 206/6.1

(58) Field of Classification Search
USPC ..... 135/16, 65–66, 72; 206/6.1, 223, 38.1, 206/216, 457; D3/7, 903
See application file for complete search history.

(56) References Cited

U.S. PATENT DOCUMENTS

| | | | | | |
|---|---|---|---|---|---|
| 275,100 | A | * | 4/1883 | Weaver | 135/66 |
| 368,077 | A | * | 8/1887 | Du Bois | 135/66 |
| 383,598 | A | * | 5/1888 | Stiebritz et al. | 135/66 |
| 399,449 | A | * | 3/1889 | Taylor | 135/66 |
| 412,550 | A | * | 10/1889 | Simon | 217/57 |
| 880,419 | A | * | 2/1908 | Swaren | 453/54 |
| 907,049 | A | * | 12/1908 | Herold | 135/66 |
| 1,129,730 | A | * | 2/1915 | Reich | 135/66 |
| 1,993,938 | A | * | 3/1935 | McDonald | 16/111.1 |
| D362,798 | S | * | 10/1995 | Porgesz | D9/663 |
| D433,793 | S | * | 11/2000 | San | D3/12 |

* cited by examiner

*Primary Examiner* — Winnie Yip

(57) ABSTRACT

A walking cane used to transport, display and immobilize objects, such as rings, is disclosed. The primary object is to provide an improved form of walking cane adapted to securely immobilize, transport and present objects, such as rings. The walking cane contains a compartment with an inlay used to immobilize, display and transport said objects, wherein the inlay contains slots designed to allow the objects to remain in an upright manner.

2 Claims, 2 Drawing Sheets

RING CANE

BACKGROUND OF THE INVENTION

The primary object of the present invention is to provide a walking cane, which provides stability for the user while in use, with an improved form of receptacle adapted to securely immobilize objects, such as rings, where the top of the invention contains a compartment with an inlay used to display, transport and immobilize the objects. The current designs for walking canes or walking cane attachments do not allow secure means of transportation, display and immobilization of small objects, such as rings.

A utensil head for walking canes is disclosed in U.S. Pat. No. 383,598 (Stiebritz). The utensil head, as claimed, consists of a receptacle for matches, an inner cover, and a match igniter outside the inner cover, all combined and arranged substantially as and for the purpose specified. The utensil head is elongated in design to specifically contain matches. Further enhancing the design, an igniter is also included in the design of the utensil head and contained in a secondary inner compartment. The compartment has no identifiable means to transport small items by securely containing the said items from movement within the vessel. The present invention does not claim to have an igniter as part of the design of the invention and also provides a means for immobilizing and displaying objects, such as rings, securely within the vessel.

U.S. Pat. No. 368,077 (DuBois) discloses an umbrella or cane head containing a chambered compartment suitable for transporting small articles. While the compartment is suitable for transporting small objects, it does not contain an inner device to securely hold, display and immobilize small objects, such as rings. The lack of such device allows the objects to move freely within the compartment. The object of the present invention, containing a horizontal inlay with slots, does not allow for objects to move freely within the compartment.

U.S. Pat. No. 275,100 (Weaver) pertains to the combination of a walking cane and pipe case consisting of a hollow cane designed to accommodate the length and curve of a long stemmed pipe. It is not the object of the present invention to contain and transport a long stemmed pipe. Furthermore, the prior invention allows for any alternate small object to move freely within the vessel.

U.S. Pat. No. 412,550 (Simon) pertains to an improvement on a swing cover for receptacles. A swing cover is not claimed or encompassed in the present invention.

U.S. Pat. No. 399,449 (Taylor) does not contain an inner compartment suitable for storing objects. Instead, it contains a solid handle with a compass and magnetic needle attached on the outside of said handle for meteorological observations. Additionally, U.S. Pat. No. Des. 433,793 (San) shows an ornamental umbrella handle consisting of a solid knob feature. This design does not encompass an opening vessel used to contain objects. The present invention contains a compartment within the head of the invention.

U.S. Pat. No. Des. 433,326 (Srinaul), U.S. Pat. No. Des. 202,448 (Shiffman), U.S. Pat. No. Des. 362,798 (Porgesz), U.S. Pat. No. Des. 244,122 (Shiffman) and U.S. Pat. No. Des 156,335 (Groos) all relate to different ornamental designs for jewelry cases. While each contains a means by which to securely hold rings, none of these prior patents relate to walking canes. It is the object of the present invention to provide a walking cane with an improved form of compartment adapted to securely immobilize objects within the compartment. Additionally, U.S. Pat. No. Des. 362,798 (Porgesz) is described in the claim and title as a jewelry case, which does not provide the same use and support as that of a walking cane.

Traditional designs for walking canes do not offer a vessel containing the capability of immobilizing an object, such as rings, within the vessel. While prior inventions for both walking canes and walking cane attachments include vessels which can carry small objects freely within the vessel, none of which contain an inlay to the compartment specifically designed to immobilize and display objects in a vertical, secure, upright manner for presentation and transportation. While prior design inventions provide the means to hold objects, such as rings, it is not the object of these design inventions to also function as a walking cane providing the support allowed by a walking cane.

Therefore, it is an object of the current invention to provide an improved walking cane containing an opening compartment which includes the means by which to securely immobilize, transport and present objects, such as rings.

SUMMARY OF THE INVENTION

The present invention is directed to a walking cane with a compartment designed to securely hold, immobilize and display objects, such as rings. The walking cane may be made of plastic or any other material that is strong and or durable. The shape of the compartment, as presented, is in the shape of a sphere, however, other shapes, such as a heart, star or diamond may be used in substitute of the sphere shape. The compartment is comprised of the base 2 and the cap 3. The cap is connected by a hinge 4 to the base allowing the top of the compartment to open. The base contains the lower portion of the compartment which is connected to the shaft 1 of the walking cane.

The internal components of the base are comprised of a horizontal inlay 5 that fits to the edge of the base containing vertical slots within the inlay designed to securely immobilize, contain and present objects, such as rings, without movement. The inlay used to display and immobilize the objects may be made of any soft or hard material such as foam, fabric or plastic.

BRIEF DESCRIPTION OF DRAWINGS

The present invention will become apparent from the following detailed description, showing the construction and elements as herein described, and more particularly defined by the appended claims, it being understood that changes in the embodiments of invention are meant to be included as coming within the scope of the claims.

For further understanding of the above features and advantages, reference is made to the detailed description and the accompanying drawings illustrate the complete preferred embodiments of the present invention.

DETAILED DESCRIPTION OF THE INVENTION

Figure 1:
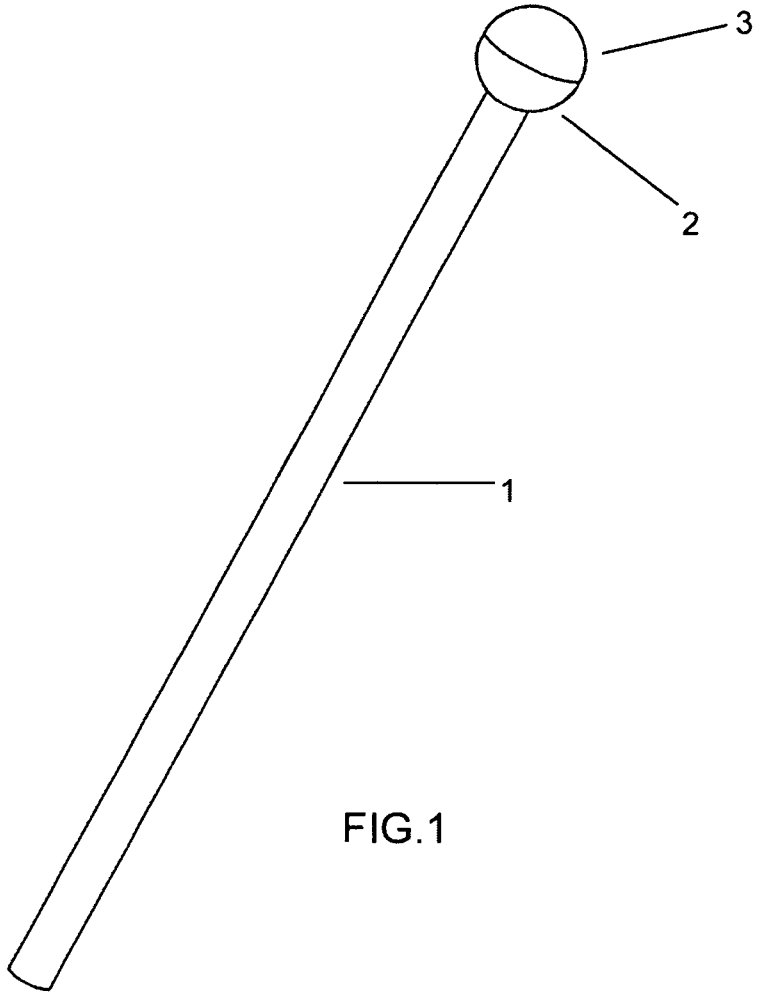
FIG. 1 is a perspective view of the walking cane, having the ball shaped design.
Figure 2:
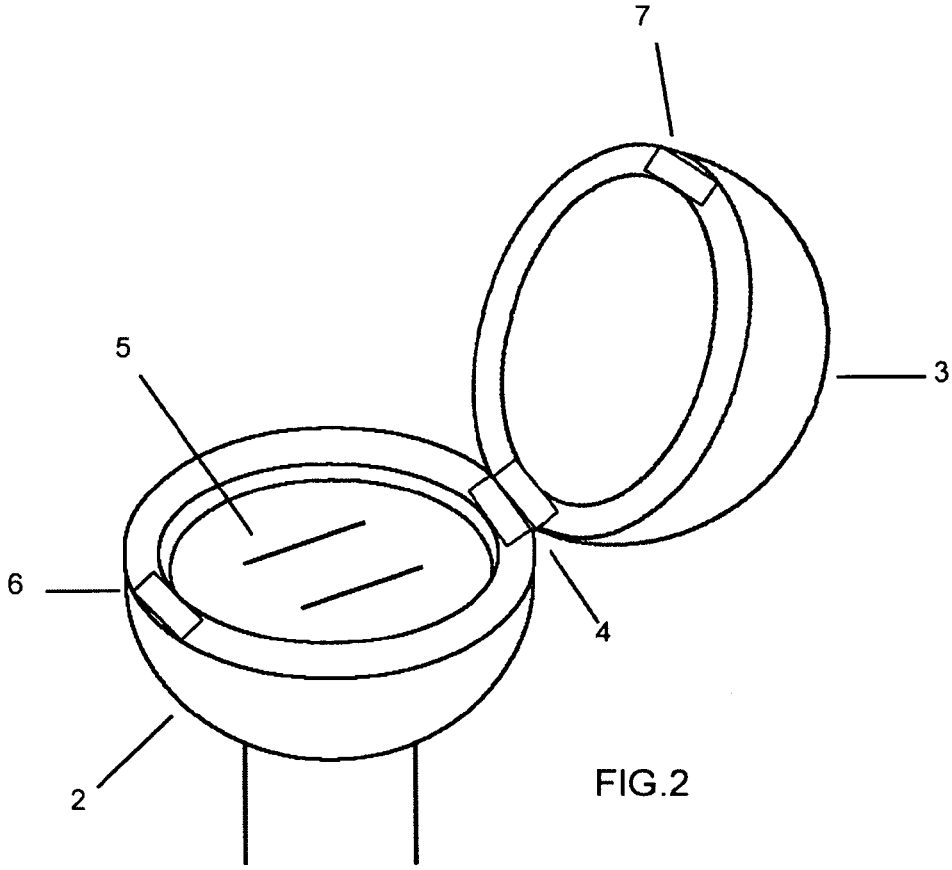
FIG. 2 shows an enlarged perspective view of the compartment, with the ball design, opened to reveal the contents therein containing an inlay with the purpose of immobilizing and displaying the objects.

The present invention relates to a walking cane comprised of a shaft 1, a base 2 and a cap 3 as shown in FIG. 1. A closer view of the compartment created by a cap 3 and a base 2 in an open position is shown in FIG. 2. The base 2 contains an inlay 5, containing parallel slots designed to immobilize objects, such as rings, and display them in an upright manner. The base 2 is permanently attached to the shaft 1. The lid 3 is hollow to allow for the objects to stand upright for display. The inlay 5 can be made of soft or hard material designed to immobilize the objects in an upright position for display.

FIG. 2 also shows the mechanism for joining a base 2 and a lid 3. The mechanism used can be any type of hinge mechanism depending on the design of manufacture, as long as the mechanism allows for the opening of the compartment. Additionally, a mechanism for securing the compartment closed is shown on the base as number 6 and the lid as number 7. Depending on the manufacture design, securing mechanisms such as a clasp, lock or magnet may be used.

Although one embodiment of the invention has been disclosed for illustrative purposes, it is understood that various modifications, changes and substitutions may be incorporated without departing from the spirit of the invention as defined by the claims hereinafter.

What the invention claimed is:

1. A walking cane for a person walking and presenting, comprising:

an elongated shaft having a top end and a lower end; the lower end being able to contact a ground surface while a person walking, the top end having a handle for allowing a person to grip while using; the handle comprising a compartment, the compartment having a base and a cap, the base attached to the top end of the shaft, the cap pivotally attached to the base by a hinged mechanism for allowing the cap to open and close the compartment, the base and the cap having a securing mechanism for securing the compartment in a closed position; the base of the compartment including an inner space containing a horizontal inlay made of soft or hard material, the horizontal inlay containing parallel vertical slots for securely immobilizing objects in an upright position without movement within the compartment for safe transporting while walking and for displaying the object in an elevating position while presenting, and the horizontal inlay providing a resting spot for the object to be lay flat within the compartment.

2. The walking cane of claim 1, wherein the handle having a spherical configuration.

* * * * *